US005507710A

United States Patent [19]

Chen

[11] Patent Number: 5,507,710

[45] Date of Patent: Apr. 16, 1996

[54] ADJUSTABLE HORSE-RIDING TYPE EXERCISER

[76] Inventor: Paul Chen, 5th Floor, No. 31, Gan Tzou 2nd St., Shi Tun Chu, Taichung, Taiwan

[21] Appl. No.: 442,346

[22] Filed: May 16, 1995

[51] Int. Cl.[6] ..... A63B 69/06

[52] U.S. Cl. ..... 482/72; 482/95; 482/57

[58] Field of Search ..... 482/72, 95, 57, 482/96, 106, 110, 111, 148; 472/110

[56] References Cited

U.S. PATENT DOCUMENTS 4,641,833 2/1987 Trethoway ..... 482/72
5,342,269 8/1994 Huang et al. ..... 482/95
5,356,357 10/1994 Wang et al. ..... 482/72
5,453,066 9/1995 Richter, Jr. ..... 482/96
5,458,553 10/1995 Wu ..... 482/95

*Primary Examiner*—Jerome Donnolly
*Attorney, Agent, or Firm*—Morton J. Rosenberg; David I. Klein

[57] ABSTRACT

A horse riding type exerciser includes a seat post pivotally coupled to a base. A handle is pivotally coupled to the base at a pivot shaft and has a panel secured to the handle and rotatable about the pivot shaft. A number of pivot axles are arranged on the panel and located above and below the pivot shaft. A link pivotally couples the seat post to either of the pivot axles. When the link is coupled to the pivot axle located above or below the pivot axle, the exerciser may be used for conducting either pull type or push type exercises.

4 Claims, 3 Drawing Sheets

ADJUSTABLE HORSE-RIDING TYPE EXERCISER

BACKGROUND OF THE INVENTION

1. Field of the Invention

The present invention relates to an exerciser, and more particularly to a horse-riding type exerciser convertible to both pull type and push type exercises.

2. Description of the Prior Art

Various kinds of horse riding type exercisers have been developed. Four prior arts are disclosed in U.S. Pat. No. 5,342,269 to Huang et al. issued Aug. 30, 1994; U.S. Pat. No. 5,356,357 to Wang et al. issued Oct. 18, 1994; U.S. Pat. No. 5,356,358 to Chen issued Oct. 18, 1994; and U.S. Pat. No. 5,366,428 to Liao issued Nov. 22, 1994.

However, the typical horse riding type exercisers are pull type exercisers, i.e., the handle bar may be pulled for conducting horse riding type exercises. The exercisers may not be used for conducting push type exercisers.

The present invention has arisen to mitigate and/or obviate the afore-described disadvantages of the conventional horse riding type exercisers.

SUMMARY OF THE INVENTION

The primary objective of the present invention is to provide a convertible horse-riding type exerciser which can be used for conducting both pull type and push type horse riding exercises.

In accordance with one aspect of the invention, there is provided a horse riding type exerciser comprising a base including a front portion having a pivot shaft provided therein, including a middle portion having a pivot axis pin provided therein, and including a rear portion having a pivot pin provided therein, a seat post including a lower portion pivotally coupled to the base at the pivot axis, including an upper portion having a seat cushion provided thereon, and including a middle portion, a handle including a middle portion pivotally coupled to the base at the pivot shaft, including a hand grip means provided on top thereof and including a foot support means provided on a bottom thereof, the handle including at least one first pivot axle arranged above the pivot shaft and including at least one second pivot axle arranged below the pivot shaft, and a link including a first end pivotally coupled to the middle portion of the seat post and including a second end pivotally coupled to at least one of the pivot axles. The seat cushion is elevated when the second end of the link is coupled to the second pivot axle and when the hand grip is pulled toward the seat cushion. The seat cushion is elevated when the second end of the link is coupled to the first pivot axle and when the hand grip is pushed away from the seat cushion.

A panel means is secured to the middle portion of the handle and includes a center portion coincide with the the pivot shaft, the first pivot axle is provided on the panel means and located above the pivot shaft, and the second pivot axle is provided on the panel means and located below the pivot shaft.

The panel means includes a semi-circular shape having a peripheral portion, the exerciser includes a plurality of pivot axles provided in the peripheral portion of the panel means for coupling to the second end of the link so as to adjust a relative position between the handle and the seat post.

A pole includes a lower portion pivotally coupled to the base at the pivot pin and includes an upper portion, and a back support includes a lower and front portion pivotally coupled to the seat post, includes a middle portion pivotally coupled to the upper portion of the pole, and includes an upper portion having a back cushion provided thereon. The back support includes a block provided on the middle portion for engaging with the seat post.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

A horse-riding type exerciser in accordance with the present invention may be used for conducting both pull type and push type horse riding exercises. A co-pending U.S. patent application was filed on Jun. 7, 1994 with the application Ser. No. 08/272,767, now allowed. The co-pending U.S. patent application is taken as a reference. The present invention is provided to simplify the configuration and to reduce the manufacturing cost of the co-pending application.

Figure 1:
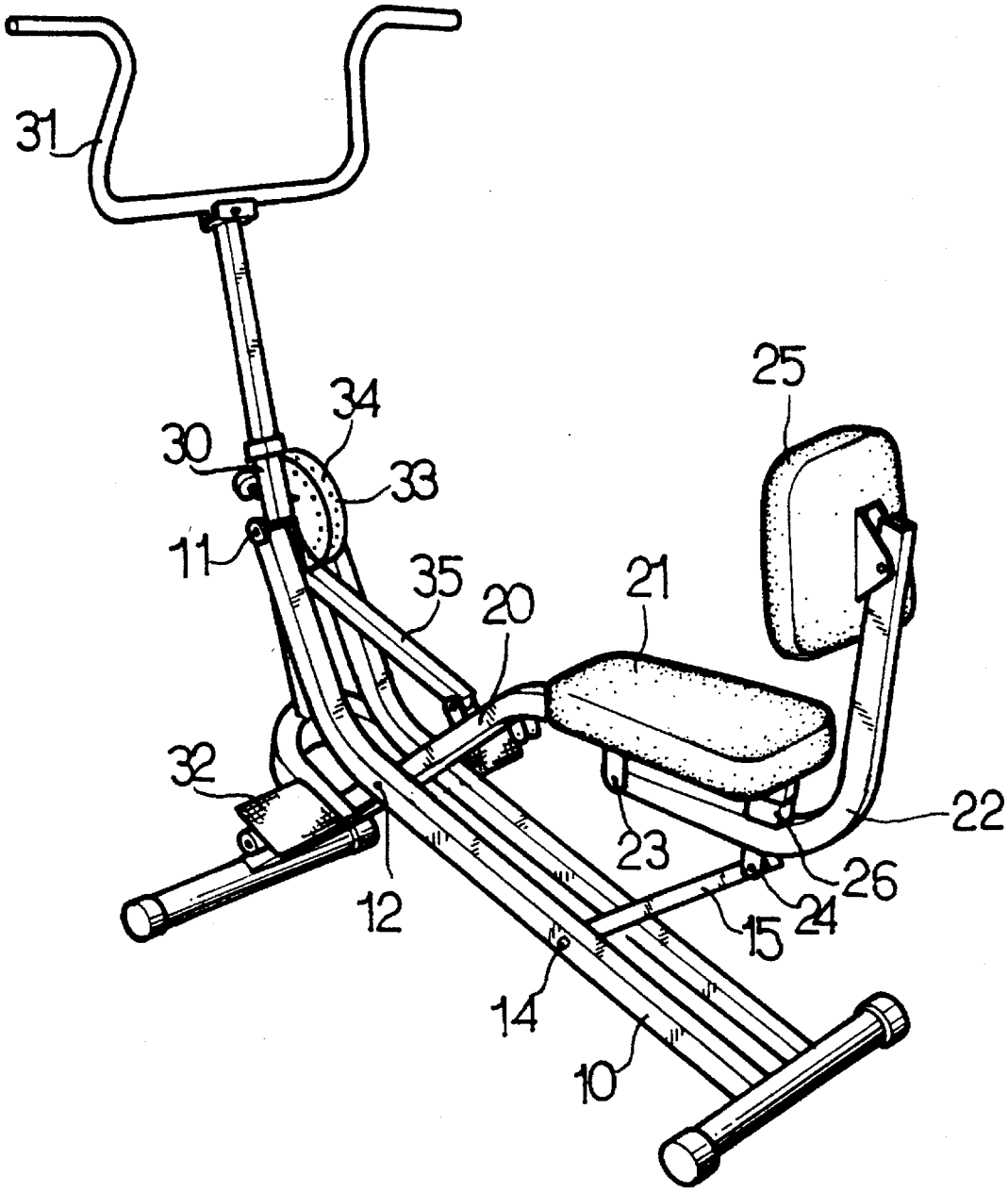
FIG. 1 is a perspective view of a horse-riding type exerciser in accordance with the present invention.
Figure 2:
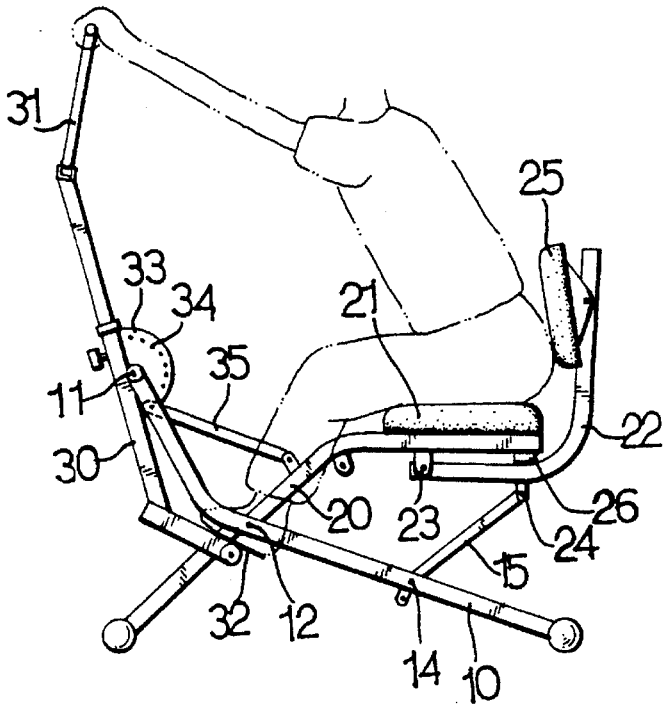
FIGS. 2, 3, 4 and 5 are plane views illustrating the operation of the adjustable horse-riding type exerciser.

Referring to the drawings, and initially to FIGS. 1 and 2, the exerciser in accordance with the present invention comprises a base 10 including a pivot shaft 11 provided in the front and upper portion thereof, including a pivot axis pin 12 provided in the middle portion, and including a pivot pin 14 provided in the rear portion thereof. A pole 15 includes a lower portion pivotally coupled to the base 10 at the pivot pin 14. A seat post 20 includes a lower portion pivotally coupled to the base 10 at the pivot axis 12 and includes a seat cushion 21 provided on the upper portion thereof. A back support 22 includes a front and lower portion pivotally coupled to the seat post 20 by a pin element 23, includes a middle portion pivotally coupled to the upper end of the pole 15 and includes a back cushion 25 provided on top thereof. The back support 22 further includes a block 26 disposed on the middle portion for engaging with the seat post 20.

Figure 3:
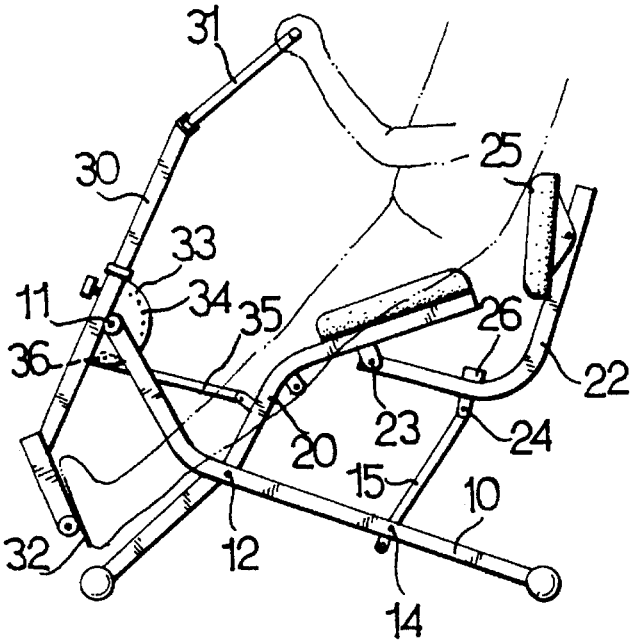
Figure 5:
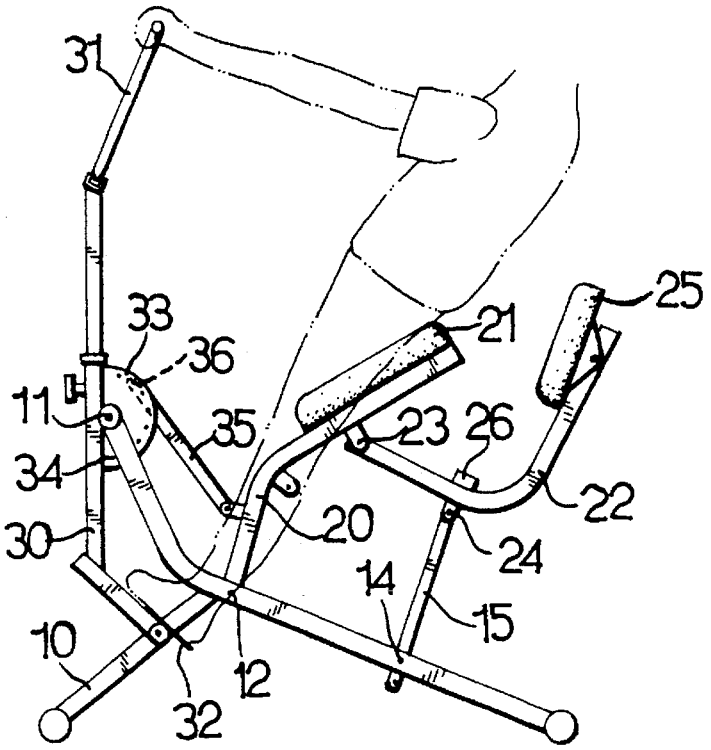
Figure 4:
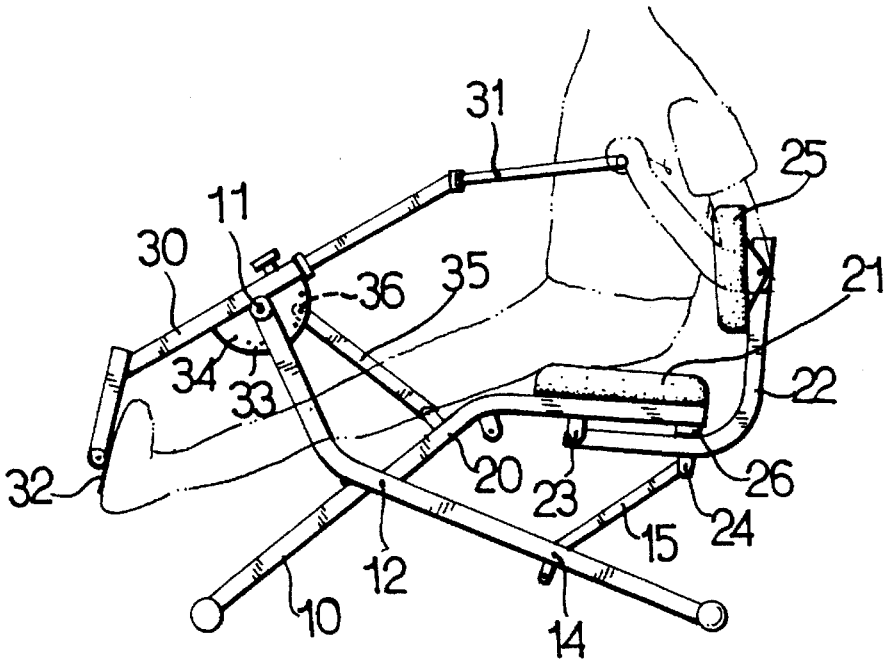

A handle 30 includes a hand grip means 31 provided on top thereof and includes a foot pedal means 32 provided on the bottom portion thereof. The handle 30 includes a middle portion pivotally coupled to the base 10 at the pivot shaft 11. A pair of panels 33 are substantially semi-circular in shape and are secured to the middle portion of the handle 30. The panels 33 include a center portion coincide with the pivot shaft 11 such that the panels 33 are also rotatable about the pivot shaft 11. The panels 33 each includes a peripheral portion having a number of holes 34 formed therein. A link 35 includes one end pivotally coupled to the middle portion of the seat post 20 and includes the other end pivotally coupled to either of the holes by pivot axles 36 (FIG. 3).

It is to be noted that the holes 34 or the pivot axles 36 include one or more thereof located above the pivot shaft 11 and includes the other located below the pivot shaft 11. As shown in FIGS. 2 and 3, when the link 35 is coupled to the holes 34 located below the pivot shaft 11, the seat cushion 21 may be elevated when the hand grip 31 is pulled by the users such that the users may conduct pull type horse riding type exercises. However, when the the link 35 is coupled to the holes located above the pivot shaft 11, the seat cushion 21 may be elevated when the hand grip 31 is pushed forward by the users such that the users may conduct push type horse riding type exercises.

It is further to be noted that the holes 34 are formed in the peripheral portion of the panels 33. When the link 35 is coupled to different holes 34, the relative position between the handle 30 and the seat post 20 may be adjusted according to the different sizes of the users.

Accordingly, the horse-riding type exerciser in accordance with the present invention can be used for conducting both pull type and push type horse riding exercises. In addition, the link may be coupled to different holes formed in the peripheral portion of the panels so as to adjust the relative position between the handle and the seat post.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A horse riding type exerciser comprising:

a base including a front portion having a pivot shaft provided therein, including a middle portion having a pivot axis pin provided therein, and including a rear portion having a pivot pin provided therein, a seat post including a lower portion pivotally coupled to said base at said pivot axis, including an upper portion having a seat cushion provided thereon, and including a middle portion, a handle including a middle portion pivotally coupled to said base at said pivot shaft, including a hand grip means provided on top thereof and including a foot support means provided on bottom thereof, said handle including at least one first pivot axle arranged above said pivot shaft and including at least one second pivot axle arranged below said pivot shaft, a link including a first end pivotally coupled to said middle portion of said seat post and including a second end pivotally coupled to either of said first and second pivot axles, and;

a pole including a lower portion pivotally coupled to said base at said pivot pin and including an upper portion, and a back support including a lower and front portion pivotally coupled to said seat post, including a middle portion pivotally coupled to said upper portion of said pole, and including an upper portion having a back cushion provided thereon, and;

wherein, said seat cushion is elevated when said second end of said link is coupled to said second pivot axle and when said hand grip is pulled toward said seat cushion; and said seat cushion is elevated when said second end of said link is coupled to said first pivot axle and when said hand grip is pushed away from said seat cushion.

2. An exerciser according to claim 1 further comprising a panel means secured to said middle portion of said handle and including a center portion coincide with said said pivot shaft, said first pivot axle being provided on said panel means and located above said pivot shaft, and said second pivot axle being provided on said panel means and located below said pivot shaft.

3. An exerciser according to claim 1, wherein said panel means to semi-circular shaped having a peripheral portion, said exerciser includes a plurality of pivot axles provided in said peripheral portion of said panel means for coupling to said second end of said link so as to adjust a relative position between said handle and said seat post.

4. An exerciser according to claim 1, wherein said back support includes a block provided on said middle portion for engaging with said seat post.

* * * * *